US006473056B2

(12) United States Patent
Annamaa

(10) Patent No.: US 6,473,056 B2
(45) Date of Patent: Oct. 29, 2002

(54) MULTIBAND ANTENNA

(75) Inventor: Petteri Annamaa, Oulu (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 09/879,735

(22) Filed: Jun. 11, 2001

(65) Prior Publication Data

US 2001/0050656 A1 Dec. 13, 2001

(30) Foreign Application Priority Data

Jun. 12, 2000 (FI) ..... 20001387

(51) Int. Cl.[7] ..... H01Q 1/37
(52) U.S. Cl. ..... 343/895; 343/702
(58) Field of Search ..... 343/702, 895, 343/906

(56) References Cited

U.S. PATENT DOCUMENTS

| | | | | | |
|---|---|---|---|---|---|
| 3,852,759 | A | | 12/1974 | Felsenheld et al. | 343/729 |
| 4,169,267 | A | | 9/1979 | Wong et al. | 343/895 |
| 5,329,287 | A | | 7/1994 | Strickland | 343/752 |
| 5,742,259 | A | * | 4/1998 | Annamaa | 29/600 |
| 5,805,112 | A | * | 9/1998 | Cassel | 343/702 |
| 5,892,480 | A | | 4/1999 | Killen | 343/895 |
| 5,914,689 | A | * | 6/1999 | Cockson | 343/702 |
| 6,025,816 | A | * | 2/2000 | Dent et al. | 343/700 MS |
| 6,275,198 | B1 | * | 8/2001 | Kenoun et al. | 343/702 |

FOREIGN PATENT DOCUMENTS

| | | | |
|---|---|---|---|
| EP | 0736926 | 10/1996 | H01Q/1/36 |
| EP | 0964474 A3 | 8/2000 | |
| GB | 2328084 A | 2/1999 | |
| GB | 2351849 | 1/2001 | |
| WO | WO 99/43042 | 8/1999 | |
| WO | WO 99/63626 | 12/1999 | |

* cited by examiner

*Primary Examiner*—Tan Ho
(74) *Attorney, Agent, or Firm*—Darby & Darby

(57) ABSTRACT

The invention relates to a multiband antenna structure suitable for mobile stations in particular. The radiating elements of the antenna include not only a helix (210) but also the joining piece (220) that attaches the helix to the apparatus. The helix is shaped such that the distance between its conductor turns varies. The electrical length of the joining piece is increased e.g. by means of a conductive projection (226) that remains within the covering of the apparatus. By suitably dimensioning the parts, at least five of the resonances that the helix and joining piece have together and separately are arranged at useful points on the frequency scale. The structure according to the invention is despite the several bands simple and relatively low in production costs.

8 Claims, 3 Drawing Sheets

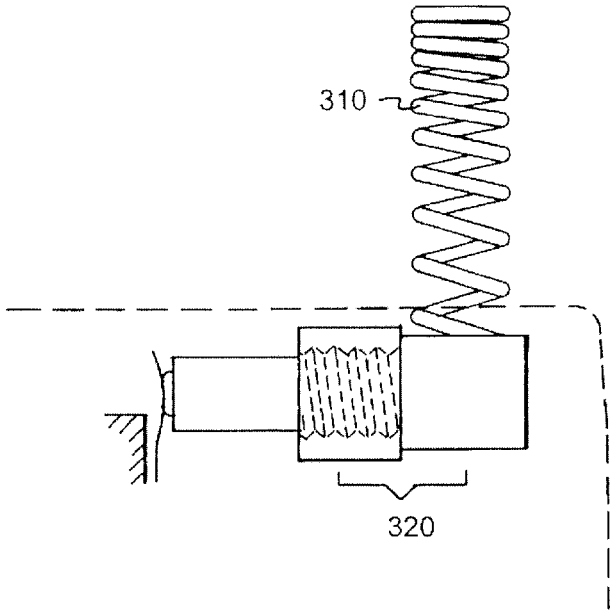
FIG. 3
FIG. 4
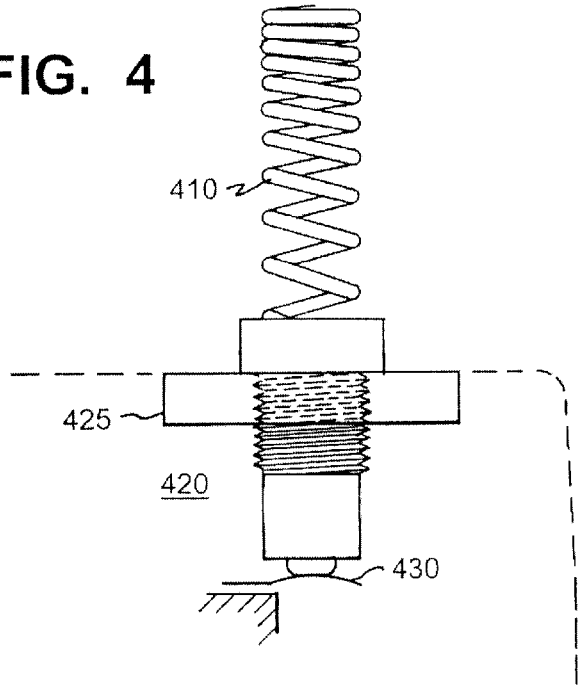
FIG. 6
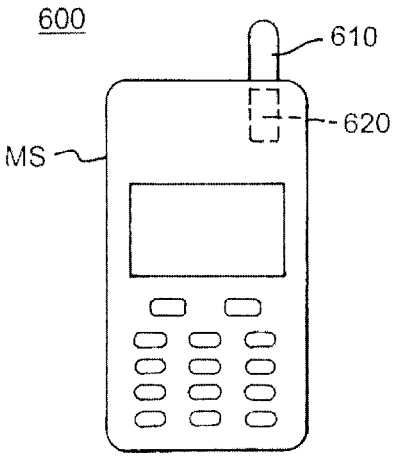

MULTIBAND ANTENNA

BACKGROUND OF THE INVENTION

1. Field of Use

The invention relates to a multiband antenna structure suitable for mobile stations in particular.

2. Description of Related Art

The development in mobile stations is leading towards apparatuses functioning in a plurality of frequency bands. At first, mobile phones operated each in one frequency band only. Then, models functioning in two frequency bands, such as GSM900 and GSM1800 systems, were introduced into the market. The introduction of WCDMA (wideband code division multiple access) technology and extension of the GSM (global system for mobile communications) technology into the frequency band earlier used by the NMT450 system result in the manufacture of models functioning in even more bands. This means additional requirements accordingly on the antennas of the mobile communication devices in question.

From the prior art it is known several antenna structures functioning in at least two frequency bands. These structures usually comprise two parts arranged to resonate at different frequency bands. The parts may be separate helix elements, a helix and a whip, branches of the radiating plane of a planar inverted F type antenna (PIFA), or meander and planar elements on a surface of a printed circuit board, for instance. An arrangement is also known in which the fundamental frequency of an individual antenna element falls into the band used by a radio system, and a harmonic of the fundamental frequency falls into the band used by another radio system. An example of this is shown in FIG. 1. The figure shows a helix-type antenna element 110, connecting piece 120, and an antenna feed conductor 130. The element 110 is at its lower end attached to the connecting piece 120 which in turn can be screwed into the body or shell structure of the apparatus. In the element 110, the pitch, or the distance between two successive turns, measured in the direction of the axis of the element, gets smaller approaching the upper end of the element. For example, a pitch p1 is smaller than a pitch p2 at a lower point in the element. The feed conductor 130 is galvanically connected to the lower end of the helix element 110 and extends downwards through an axial hole in the connecting piece 120. The connecting piece may be conductive, but isolated from the helix, whereby it further serves as a shield for the end portion of the feed conductor. FIG. 1 further shows in dashed line also the outline of the protective hood of the antenna.

All antenna elements resonate at a certain fundamental frequency and also at harmonic frequencies of the fundamental frequency. The fundamental frequency refers here to the frequency at which the electrical length of the antenna element equals a quarter of the wavelength. If the pitch in a helix antenna is uniform throughout, the harmonics are multiples of the fundamental frequency. If there are different pitches, the relation between the harmonics changes. By suitably selecting the number of turns and the pitches, among other things, it is possible to have such values for the resonance frequencies that the structure is applicable in the frequency bands of at least two radio systems. Usually the fundamental frequency and its third harmonic are arranged at the desired locations on the frequency axis. The third harmonic means the third resonance frequency when the fundamental frequency is counted as the "first harmonic".

A common drawback in arrangements according to FIG. 1 and in comparable arrangements in respect to multiband use is that there are only two or at the most three frequency bands that can be used. It is true that by adding elements one can have as many bands as one wants, but then the structure with its matchings becomes bulky and complicated.

SUMMARY

An object of the invention is to reduce said drawbacks associated with the prior art. A structure according to the invention is characterized by that which is specified in the independent claim 1. Some advantageous embodiments of the invention are specified in the other claims.

The basic idea of the invention is as follows: The antenna structure has as its radiating elements not only the helix but also the joining piece that attaches the helix to the apparatus. The helix is designed such that the distance between its conductor turns varies. The electrical length of the joining piece is increased by means of a conductive projection, for example, which remains within the covering of the apparatus. By suitably dimensioning the parts at least five of the resonances that the helix and the joining piece have together, are arranged at useful locations on the frequency scale.

An advantage of the invention is that it facilitates an antenna suitable for mobile stations, which antenna has more bands than prior-art antennas. Another advantage of the invention is that the production costs of the structure according to the invention are relatively small.

BRIEF DESCRIPTION OF THE DRAWINGS

The invention is described in more detail in the following. Reference is made to the accompanying drawings in which FIG. 3 shows a second example of the antenna structure according to the invention, FIG. 4 shows a third example of the antenna structure according to the invention, FIG. 6 shows an example of a mobile station equipped with an antenna according to the invention.

DETAILED DESCRIPTION OF AN EXEMPLARY EMBODIMENT OF THE INVENTION

Figure 1:
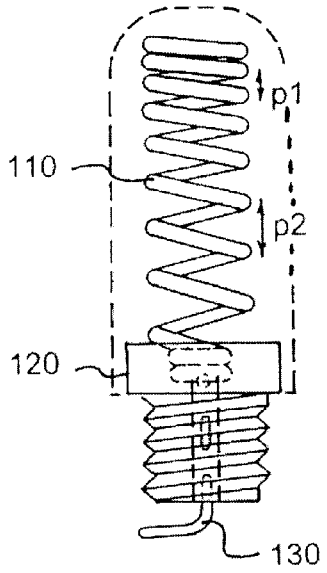
FIG. 1 PRIOR ART
FIG. 1 shows a prior-art antenna structure, FIGS. 2*a,b* show an example of the antenna structure according to the invention.

FIG. 1 was already discussed in connection with the description of the prior art.

Figure 2A:
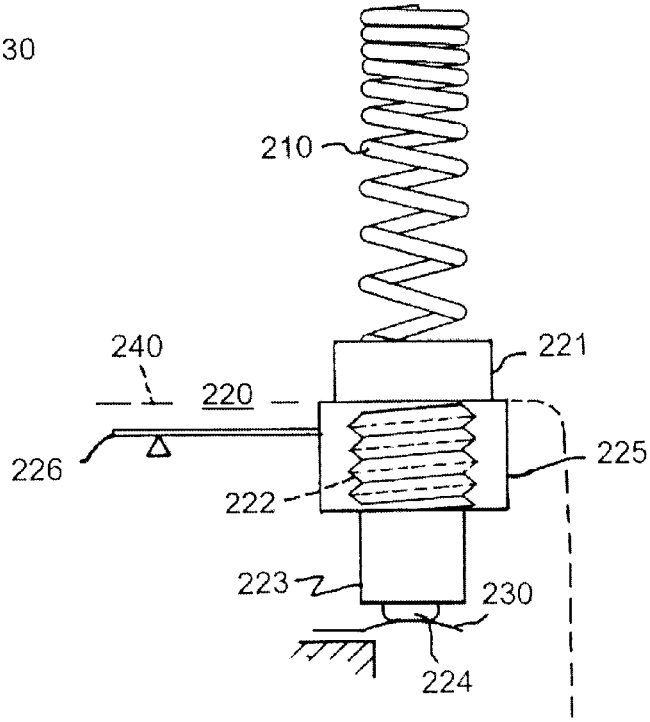

FIG. 2*a* shows a side view of an example of the antenna structure according to the invention. It comprises a helix-type antenna element 210, joining piece 220, and antenna feed conductor 230. Like in the structure shown in FIG. 1, the pitch in the helix element gets smaller from the lower end to the upper end of the element. Terms "lower", "upper", "horizontal" and "vertical" refer in this description and in the claims to the position of the antenna structure as shown in FIG. 2, and they have nothing to do with the operating position of the antenna. The joining piece 220 comprises a top part 221, thread part 222, bottom part 223, connecting part 224, counterpart 225, and a projecting part 226. All these parts are conductive and in galvanic contact with each other. The horizontal projection 226 is attached by its one end to the counterpart 225. It may be e.g. a separate flat plate or just a metal plating on the inner surface of the covering. The counterpart has got inner threads. In the example of FIG. 2 it is a nut-like part attached to the dielectric covering 240 of the apparatus. The top part 221, thread part 222, bottom part 223 and connecting part 224 form an entity which is screwed into the counterpart 225. The helix element 210 is attached by its lower end to the top part of the joining piece 220. The connecting part 224 is the lowest part in the joining piece. The feed conductor 230 comprises a bent part exerting spring force against the connecting part 224 when the antenna is installed in the apparatus.

Figure 2B:
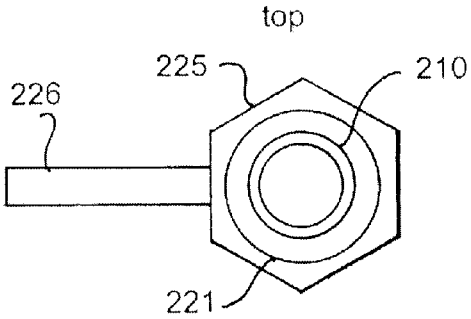

FIG. 2*b* shows a bird's-eye view of the antenna structure of FIG. 2*a*. It reveals the width of the projection 226, the round shape of the cross-sections of the helix and the top part 221 of the joining piece, and the angular shape of the cross-section of the counterpart 225 for the joining piece.

An essential difference between the structures of FIGS. 2 and 1 is that in FIG. 2 the joining piece of the helix may also function as a radiator. It is a conductive body connecting to the inner conductor 230 of the antenna feedline and does not have a conductive shield around it. The joining piece can be shortened in the vertical direction using a projection 226. The need for space for the strip-like projection in the upper part of the covering of the apparatus is insignificant. At the interface between the joining piece and the helix there is an electrical discontinuity. Therefore the helix resonates alone at certain frequencies and the joining piece resonates alone at certain other frequencies. In addition there is a frequency at which the helix and the joining piece resonate together. This common resonance frequency is the lowest of the resonance frequencies of the structure. In practice, it is possible to use it and the fundamental resonance frequency of the joining piece and one or more of the harmonics of the helix, for example. As regards the latter, the structure according to the invention goes farther than prior-art structures: the variation in the helix pitch can be arranged such that the ratios of the third, fifth and, if necessary, the seventh harmonic and the fundamental frequency are as desired.

FIG. 3 shows a second example of the structure according to the invention. The difference from the structure of FIG. 2 is that the joining piece is now horizontal so that the helix element 310 is connected to its end from the side. In addition, the joining piece does not have a projection like the projecting part 226 in FIG. 2. This means that the joining piece has to be made longer if the antenna is to function at the same frequencies as the structure of FIG. 2.

FIG. 4 shows a third example of the structure according to the invention. There the helix element 410 and joining piece 420 have a common axis, like in FIG. 2. In this case, too, the counterpart 425 of the joining piece does not include a projection. The counterpart itself is, however, larger than in the structure of FIG. 2. The purpose of the larger size is the same as that of the projection: to achieve a certain electrical length for the joining piece with a smaller vertical physical length.

Figure 5:
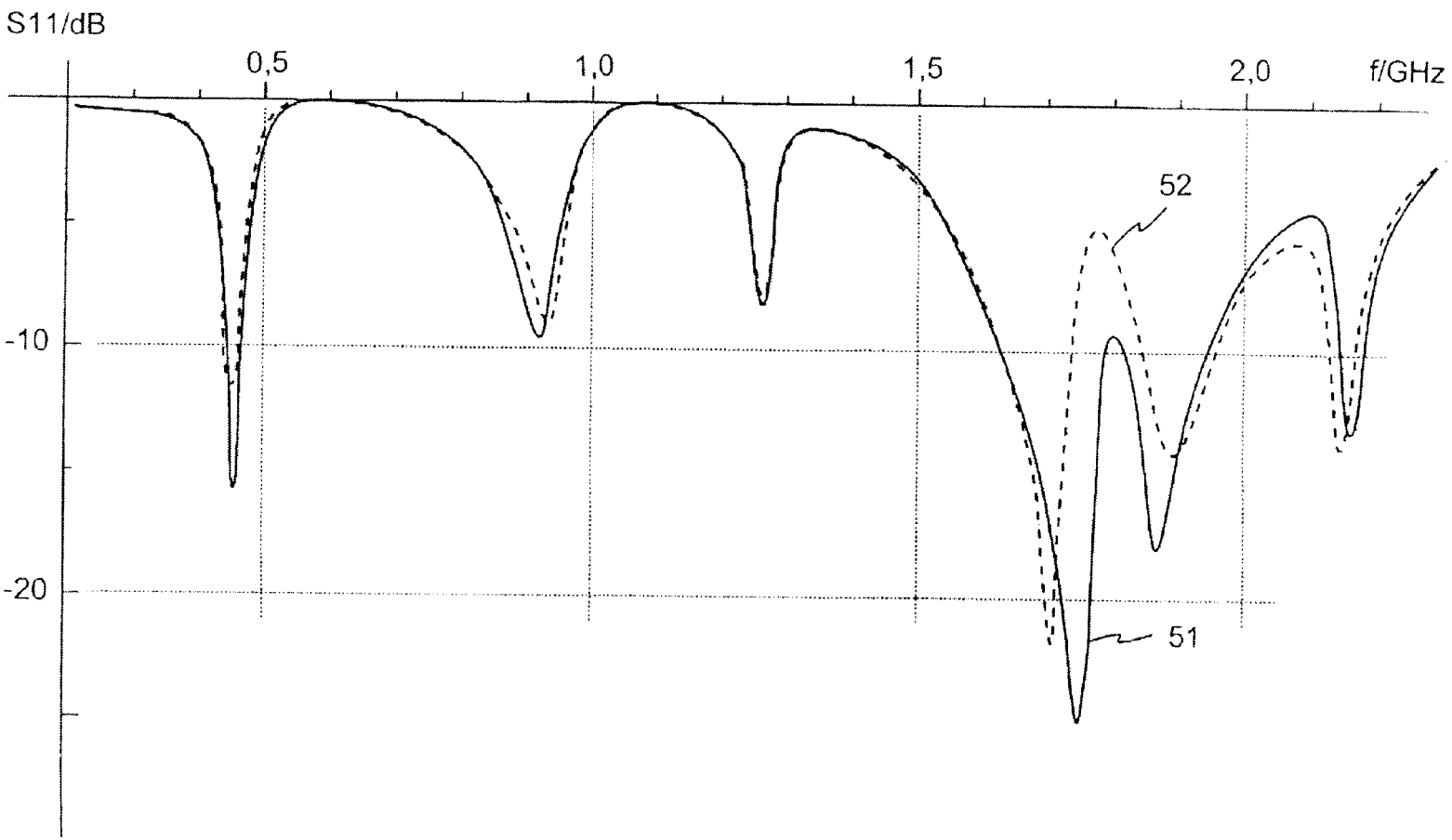
FIG. 5 shows examples of the frequency characteristics of an antenna according to the invention.

FIG. 5 shows examples of the frequency characteristics of an antenna according to the invention. It shows, as the function of frequency, the reflection coefficient of two antennas, both of which are in accordance with FIG. 2 as to their structure. Six resonance points can be seen in the first curve 51. If a criterion for a viable frequency band is that the reflection coefficient is below, say, −5 dB, the structure represented by curve 51 functions as an antenna in four frequency bands: 430–480 MHz, 860–950 MHz, 1240–1280 MHz and 1550–2230 MHz. The frequencies used by the future GSM450 system fall into the first frequency band of these. The frequencies used by the GSM900 system fall into the second frequency band of those above. With the help of a little tuning, the third band can be utilized in the GPS (global positioning system) which uses the 1227.6 MHz frequency. The frequencies used by the GSM1800, PCS1900 and WCDMA systems fall into the fourth, very wide, band. In addition, the GPS frequency 1575.42 MHz falls into that same band.

The first band 430–480 MHz is based on the common resonance of the helix element and the joining piece of the antenna. The second band 860–950 MHz is based on the third harmonic of the fundamental resonance frequency of the helix element. This is arranged a little above 900 MHz by suitably decreasing the pitch of the helix approaching the upper end of the helix. The fourth band 1550–2230 MHz is produced by arranging at suitable points three resonance frequencies: the fifth harmonic of the helix, the fundamental frequency of the joining piece and the seventh harmonic of the helix. The fifth and seventh harmonics of the helix as well as the aforementioned third harmonic have been pulled downwards by making the thread suitably more dense going up.

The second curve 52 is similar to curve 51. By slightly changing the dimensions the second band of the antenna, for example, has been arranged so as to better fall into the band used by the GSM900 system.

FIG. 6 shows a mobile station MS. It has an antenna 600 according to the invention with the helix element 610 of the antenna residing outside the covering of the mobile station and the joining piece 620 residing inside the covering. Some solutions according to the invention were described above. The invention is not limited to those solutions only. For example, the joining piece may be modified in many ways. Neither does the invention limit the manufacturing method of the antenna elements. The inventional idea can be applied in various ways within the scope defined by the independent claim.

What is claimed is:

1. An antenna structure comprising a helix element with varying distances between conductor turns, and a joining piece to which the helix element is attached by its one end galvanically, said joining piece being electrically conductive and unshielded to function as a radiator, and having fundamental resonance frequency lower than the seventh harmonic resonance frequency of said helix element.

2. A structure according to claim 1, whereby the total fundamental frequency of said helix element and said joining piece is arranged to fall into the frequency band used by a first radio system, by varying the pitch of the helix the third harmonic frequency of said helix element is arranged to fall into the frequency band used by a second radii system, by varying the pitch of the helix the fifth harmonic frequency of said helix element is arranged to fall into the frequency band used by a third radio system, the fundamental frequency of said joining piece is arranged to fall into the frequency band used by a fourth radio system, and by varying the pitch of the helix the seventh harmonic frequency of said helix element is arranged to fall into the frequency band used by a fifth radio system.

3. A structure according to claim 2, whereby said first radio system is the GSM450, said second radio system is the GSM900, said third radio system is the GSM1800, said fourth radio system is the PCS1900, and said fifth radio system is the WCDMA.

4. A structure according to claim 1, whereby said joining piece comprises a conductive projection to reduce the physical length of the joining piece in resonance.

5. A structure according to claim 1, the joining piece of which comprises a counterpart to be attached to a dielectric support material, whereby said counterpart is essentially wider than the rest of the joining piece to reduce the physical length of the joining piece in resonance.

6. A structure according to claim 1, in which the direction of the axis of the helix element is vertical, whereby the direction of the axis of said joining piece is essentially horizontal.

7. A radio apparatus comprising an antenna having a helix element with varying distance between conductor turns, and a joining piece to which the helix element is attached galvanically by its one end, said joining piece being electrically conductive and unshielded to function as a part of the radiating structure of the antenna, and having fundamental resonance frequency lower than the seventh harmonic resonance frequency of said helix element.

8. An antenna structure comprising a helix element with varying distances between conductor turns, and a joining piece to which the helix element is attached by its one end galvanically, said joining piece being electrically conductive and unshielded and having fundamental resonance frequency lower than the seventh harmonic resonance frequency of said helix element; and said joining piece further comprising a conductive projection to reduce the physical length of the joining piece in resonance.

* * * * *